US005406722A

United States Patent [19]

Jones

[11] Patent Number: 5,406,722

[45] Date of Patent: Apr. 18, 1995

[54] EMU SHOE

[76] Inventor: E. Lynn Jones, 708 Frisco, Clinton, Okla. 73601

[21] Appl. No.: 295,496

[22] Filed: Aug. 25, 1994

Related U.S. Application Data

[63] Continuation of Ser. No. 165,180, Dec. 13, 1993, abandoned.

[51] Int. Cl.[6] ..... A61D 9/00

[52] U.S. Cl. ..... 36/111; 36/83; 119/853

[58] Field of Search ..... 36/111, 83; 119/850, 119/851, 853, 856; 54/82

[56] References Cited

U.S. PATENT DOCUMENTS

| | | | |
|---|---|---|---|
| 2,197,537 | 4/1940 | Cheeley | 36/111 |
| 2,424,172 | 7/1947 | Huddleston | 36/111 |
| 2,446,371 | 8/1948 | Jones | 36/111 |
| 2,535,394 | 12/1950 | Davis | 36/111 |
| 2,651,853 | 9/1953 | Lewis | 36/111 |
| 3,209,726 | 10/1965 | Fisher | 36/111 X |
| 4,457,261 | 7/1984 | Marshall | 36/111 X |
| 4,543,911 | 10/1985 | Marshall | 36/111 X |

*Primary Examiner*—Paul T. Sewell
*Assistant Examiner*—Ted Kavanaugh
*Attorney, Agent, or Firm*—Dougherty, Hessin, Beavers & Gilbert

[57] ABSTRACT

An emu shoe for discouraging combat and aggression towards other emu which consists of a single, flat foot cover of characteristic shape which foot cover includes instep and heel panels that are firmly secured by VELCRO TM adhesive to maintain the shoe in place through all bird activity.

3 Claims, 2 Drawing Sheets

EMU SHOE

This is a continuation of application Ser. No. 08/165,380, filed on Dec. 13, 1993, now abandoned.

BACKGROUND OF THE INVENTION

1. Field of the Invention

The invention relates generally to anti-aggression devices for emus and related animals and, more particularly, but not by way of limitation, it relates to a single device in the form of a shoe for fitting on an emu to curb its combat tendencies.

2. Description of the Prior Art

The inventor is not aware of any similar types of device that are particularly adapted for protecting and maintaining a bird or animal in a more docile mood. The single shoe implement of particular shape and configuration for affixture on the leg of a large bird having an elongated, three toed foot is novel in concept and design.

SUMMARY OF THE INVENTION

The present invention relates to a shoe implement for secure placement on one foot of an emu to prevent the emu from kicking or other destructive actions while not impairing to any great degree the bird's mobility. The emu shoe consists of an oblong, heavy leather sole piece with a heel strap secured across the rear edge, said heel strap being adapted to be bent upward along the rear side of the emu leg for subsequent strapping in place. The upper part of the emu shoe consists of an oblong upper panel of lighter weight leather secured on top of the lower sole piece while allowing a rear entry foot opening. The rear edge of the upper panel includes an instep strap that extends upward for strap securing with the rear heel strap.

Therefore, it is an object of the present invention to provide a single emu shoe which imposes mild restriction on the emu movements while causing the bird to be much less aggressive.

It is also an object of the present invention to provide an emu shoe which tends to prevent the bird from using either foot for aggressive, assertive purposes.

It is yet further an object of the invention to prevent penned emus in captivity from severely injuring or even destroying one another.

Finally, it is an object of the present invention to provide an emu shoe that causes no harm or discomfort to the bird while removing all of the bird's aggressive tendencies.

Other objects and advantages of the invention will be evident from the following detailed description when read in conjunction with the accompanying drawings which illustrate the invention.

DETAILED DESCRIPTION OF THE INVENTION

The present invention is a shoe that can be securely positioned on the foot of a large bird called an emu. The emu is a large Australian ratite bird that is related to the ostrich and inhabits open forests and plains areas. The emu has long sturdy legs much like an ostrich and has an elongate three-toed foot with pointed toes. The emu fights to protect itself by using its two feet to inflict damage on the opponent, and an adult-sized emu is quite capable of inflicting severe damage in this manner. Emus are currently being raised in commercial herds in southwestern United States and it has been found that the wearing of a single emu shoe per bird, or on the more aggressive birds, eliminates the destruction of birds when they are herded together. For some reason, when a single emu shoe 10 (FIG. 1) is worn by a bird it ceases to engage in combat with either foot, and the presence of a single emu shoe 10 does not seem to greatly bother the bird or lessen his mobility.

Figure 1:
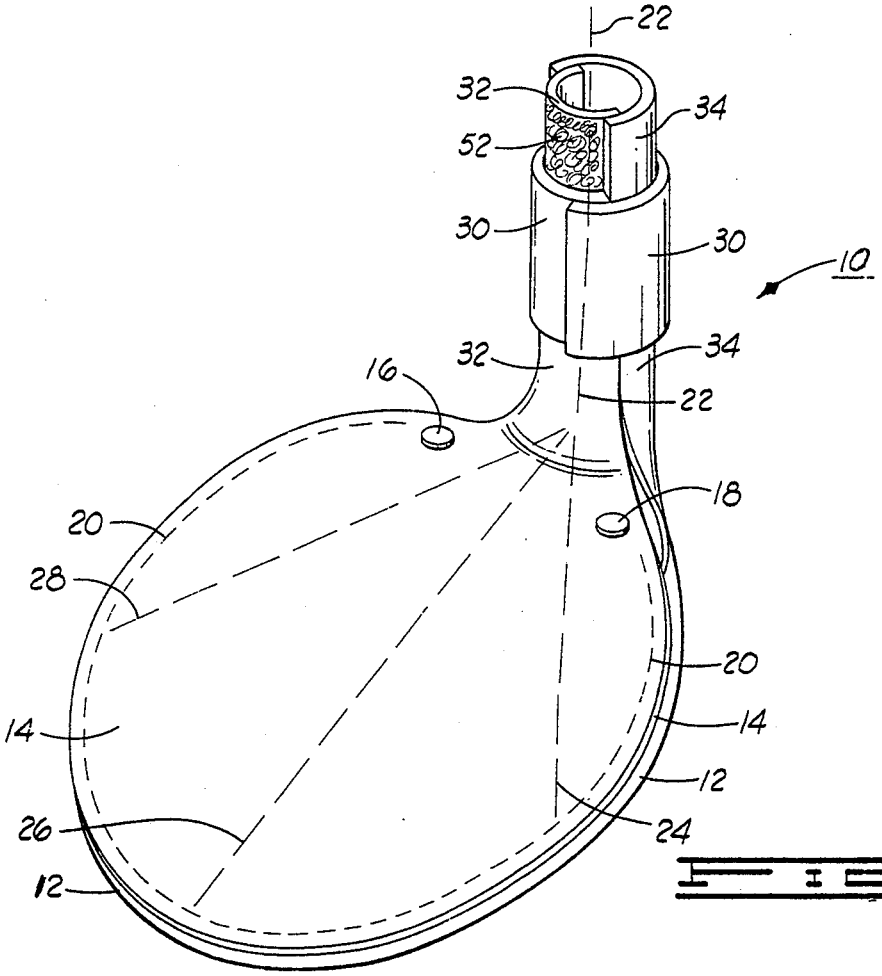
FIG. 1 is a perspective view of the emu shoe in the donned attitude.

As shown in FIG. 1, the emu shoe 10 includes a bottom sole 12 of generally oblong shape, i.e., about 8 inches in width and about 9 inches in length from heel to toe. A lighter leather upper panel 14 of similar oblong shape is secured on top of the bottom sole 12 by means of a pair of copper rivets 16 and 18 and peripheral stitching 20. The stitching 20 is preferably double stitched of very heavy boot thread.

The emu foot is inserted into the shoe 10 generally between the rivets 16 and 18 in the manner shown with dash-line 22 representing the axis of the emu leg, and dash-lines 24, 26 and 28 showing alignment of the three toes of the bird. The emu shoe 10 is secured tightly on the foot by a securing strap 30 which is secured by hook and pile strip material known as VELCRO TM (to be described) around instep panel 32 and coacting heel panel 34.

Figure 3:
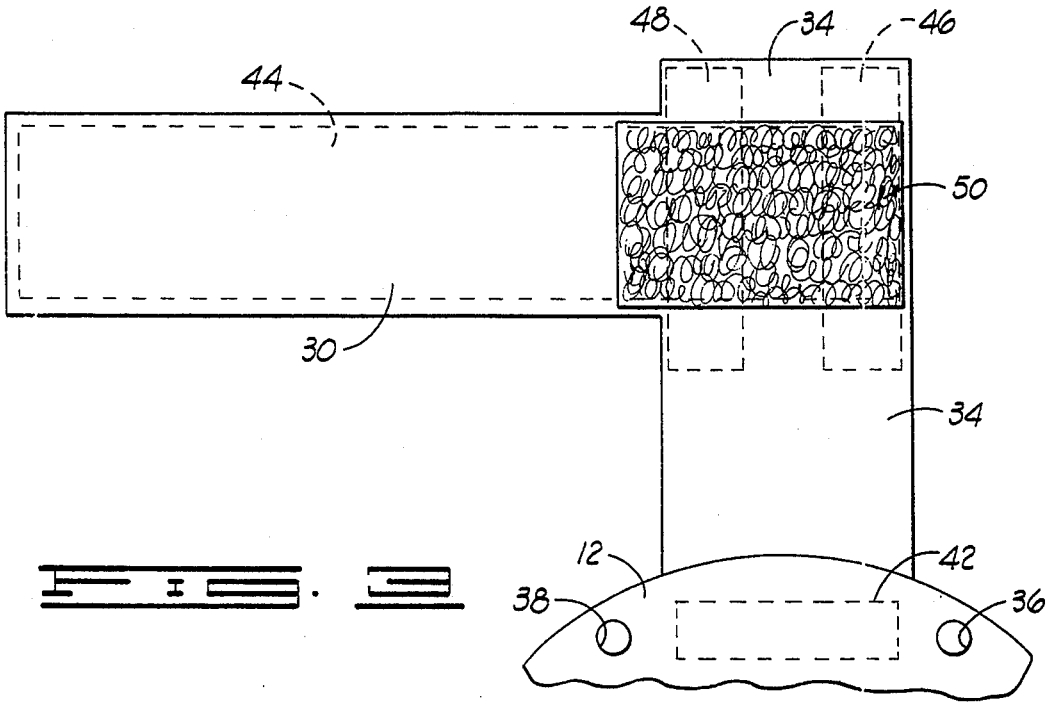
FIG. 3 is a back plan view of a portion of the sole panel with heel strap attached.
Figure 2:
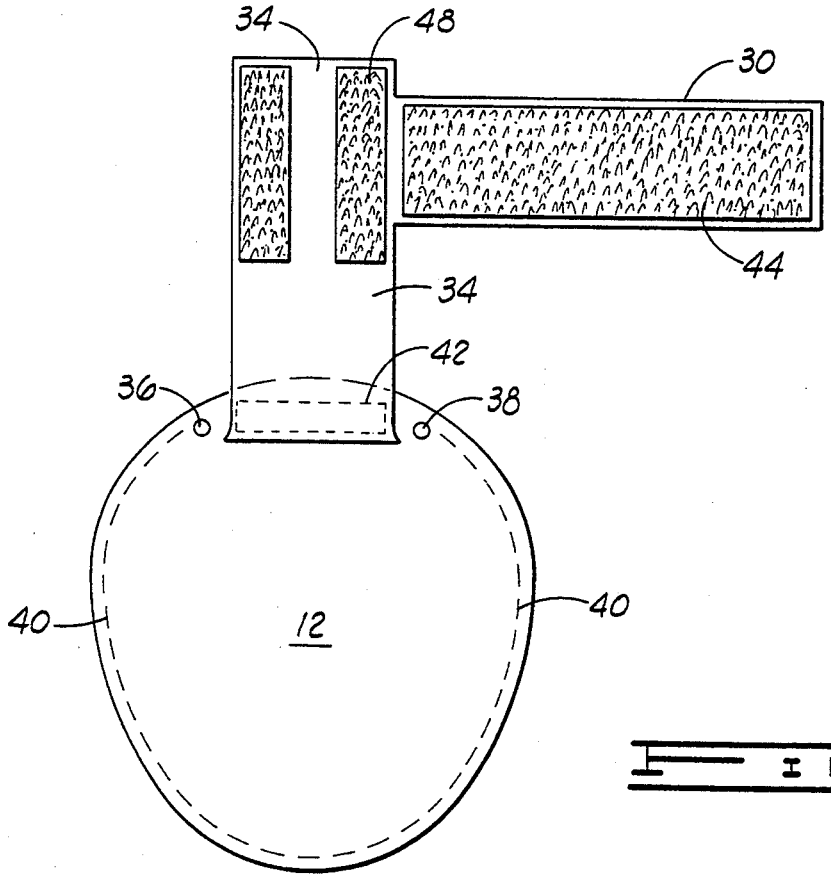
FIG. 2 is a plan view of the bottom sole panel and heel strap of the emu shoe.

Referring now to FIG. 2, the bottom sole 12 is shown in layout as it is constructed from 8% calf leather, about 3/16 inches thick, as it is formed with rivet holes 36 and 38 at opposite sides of a peripheral stitch line 40. The heel panel 34 of generally rectangular shape is secured as by stitching 42 to the upper side of bottom sole 12 between the rivet holes 36 and 38. The heel panel 34 extends a strap 30 covered with VELCRO TM hook material 44 suitably secured as by stitching. Also, the upper side portions of heel strap 34 include VELCRO TM hook strips 46 and 48 secured along the upper sides thereof. As shown in FIG. 3, the opposite side of heel panel 34 (rear facing) has a piece of VELCRO TM pile 50 secured thereon for receiving VELCRO TM hooks 44 of ankle strap 30 after a firm wrap around the leg bone.

Figure 4:
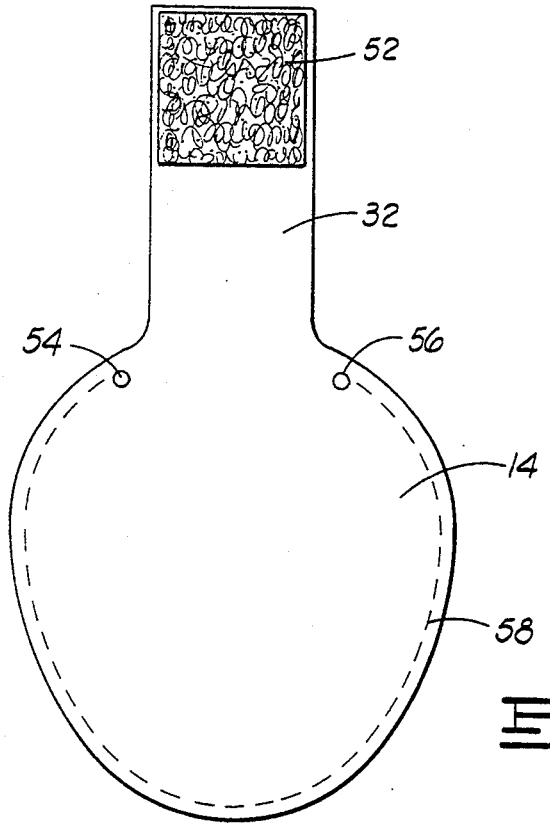
FIG. 4 is a plan view of the upper panel of the emu shoe.

FIG. 4 illustrates the upper panel 14 which is formed from such as 4% calfskin and extending into the instep panel 32 that has a panel of VELCRO TM pile 52 secured thereon. The oblong upper panel 14 is formed with rivet holes 54 and 56 at each end of a peripheral stitch line 58. Thus, the shoe is finally constructed as shown in FIG. 1 with upper panel 14 secured to bottom sole 12 by means of rivets 16 and 18 and heavy duty stitching 20 around the periphery.

In operation, the shoe 10 is placed upon the emu foot in a manner shown in FIG. 1, axes 22, 24, 26 and 28 representing the lower leg bone and three toes of the bird. It can be noted that there is ample room within the oblong formation of bottom sole 12 and upper panel 14 as it allows comfortable placement on the bird's foot with only a firm seizure around the bird's lower leg bone by the secured instep panel 32 and heel panel 34. Referring also to FIGS. 2, 3 and 4, the emu shoe is secured around the lower bird leg by means of the various VELCRO TM seizure combinations maintained by the securing strap 30.

Thus, the instep panel 32 is laid up against the front portion of the leg as the heel panel 34 is placed firmly against the back part of the leg bone and the VELCRO TM hook strips 46 and 48 (FIG. 2) then overlap on the VELCRO TM pile pad 52. This seizure is further locked in place by wrapping the securing strap 30 and the VELCRO TM hook strip 44 across the instep VELCRO TM pad 52 and around the pad assembly and bird leg to a final securing point where VELCRO TM hooks pad 44 closes over the rear pile pad 50 (see FIG. 3). The emu shoe is then tightly but comfortably secured on the leg of the bird. It is not necessary to place a shoe on the remaining bird foot since the wearing of a single shoe completely defeats the emu's aggressive tendencies and the bird is no longer a threat to his fellow pen mates.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A leather shoe for placement on a selected foot and leg of an emu to discourage pedal combat, comprising:

a sole panel of generally rounded, ovate shape that is slightly longer than wide to accommodate the three toed foot of an emu, said sole panel having a rear edge and said sole panel being a stiff leather panel approximately three-sixteenth inches in thickness;

a resilient upper panel of similar shape to said sole panel and approximately one-sixteenth inches in thickness, said upper panel being secured on said sole panel around the peripheral edge while defining an opening between sole and upper panels at the rear edge;

an instep panel extending rearward from said upper panel;

a heel panel secured to extend rearward from said sole panel rear edge while including a securing strap extending at a right angle therefrom; and hook and pile fasteners securing the securing strap around both said instep panel and heel panel in surround of the emu lower leg.

2. A leather shoe as set forth in claim 1 wherein said hook and pile fasteners comprise:

a pile pad secured on said instep panel; and a hook strip secured on said heel panel and said securing strap to secure said instep panel to said heel panel.

3. A leather shoe as set forth in claim 1 wherein said hook and pile fasteners comprise:

a first pile pad secured on the front side of said instep panel;

a second pile pad secured on the rear side of said heel panel; and a plurality of hook strips secured to the front side of said heel panel and securing strap for engaging said first and second pile pads.

* * * * *